US007690182B2

(12) United States Patent
Aratani et al.

(10) Patent No.: US 7,690,182 B2
(45) Date of Patent: Apr. 6, 2010

(54) STRAIGHT-TYPE FINISH FOR SYNTHETIC FIBERS, PROCESSING METHOD FOR FALSE TWISTED TEXTURED YARNS USING SAME, AND FALSE TWISTED TEXTURED YARNS

(75) Inventors: Satoshi Aratani, Gamagori (JP); Atsushi Toda, Gamagori (JP); Makoto Hattori, Gamagori (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 167 days.

(21) Appl. No.: 12/124,842

(22) Filed: May 21, 2008

(65) Prior Publication Data

US 2008/0302079 A1 Dec. 11, 2008

(30) Foreign Application Priority Data

Jun. 8, 2007 (JP) ..... 2007-152246
Dec. 11, 2007 (JP) ..... 2007-319718

(51) Int. Cl.
*D01H 13/30* (2006.01)

(52) U.S. Cl. ..... 57/286

(58) Field of Classification Search ..... 57/286; 252/8.81, 8.84; 428/392, 394
See application file for complete search history.

(56) References Cited

U.S. PATENT DOCUMENTS

| | | | | |
|---|---|---|---|---|
| 4,351,738 | A * | 9/1982 | Takahashi et al. | 428/395 |
| 5,491,026 | A * | 2/1996 | Mudge et al. | 428/395 |
| 7,021,349 | B2 * | 4/2006 | Klein | 152/451 |
| 2005/0038283 | A1 * | 2/2005 | Kawahara et al. | 560/76 |

FOREIGN PATENT DOCUMENTS

EP 1626117 A2 * 2/2006

* cited by examiner

*Primary Examiner*—Shaun R Hurley
(74) *Attorney, Agent, or Firm*—Weaver Austin Villeneuve & Sampson LLP

(57) ABSTRACT

A straight-type finish, which has improved storage characteristics and is capable of preventing synthetic fibers from becoming electrically charged and uneven dyeing from being generated, contains a lubricant and a functional improvement agent at specified ratios. A metal organic sulfonate of a specified type is contained at least as a part of the functional improvement agent at a specified mass % of the total.

17 Claims, No Drawings

STRAIGHT-TYPE FINISH FOR SYNTHETIC FIBERS, PROCESSING METHOD FOR FALSE TWISTED TEXTURED YARNS USING SAME, AND FALSE TWISTED TEXTURED YARNS

Priority is claimed on Japanese Patent Applications 2007-152246 filed Jun. 8, 2007 and 2007-319718 filed Dec. 11, 2007.

BACKGROUND OF THE INVENTION

This invention relates to a straight-type finish for synthetic fibers, a processing method for false twisted textured yarns using the same and such false twisted textured yarns. In the production and fabrication of synthetic yarns, it has been known that the synthetic fibers tend to become electrically charged due to the mutual friction of the synthetic fibers and the friction with the guides, etc. during the false twisting of the synthetic fibers, for example, and that such static electricity causes imperfect cohesion, tension variations and yarn breaking, resulting in uneven dyeing at the time of the dyeing process. In order to prevent such occurrences, agents for providing smoothness and antistatic characteristics to synthetic fibers are employed in the production and fabrication of synthetic fibers. The present invention relates to a straight-type finish as an example of such agents for synthetic fibers, and a processing method for false twisted textured yarns using such a finish, as well as such false twisted textured yarns.

Examples of conventionally known processing agent for providing smoothness and antistatic characteristics to synthetic fibers include (1) those containing alicyclic polycarboxylic acid esters of alicyclic polycarboxylic acid and straight chain alcohol with 1-18 carbon atoms, branched alcohol with 3-18 carbon atoms or alicyclic alcohol with 3-10 carbon atoms with terminal normal chain ratio of 50% or more (as disclosed, for example, in Japanese Patent Publication Tokkai 10-265789); (2) those containing copolymers with molecular weight of 20,000-1,000,000 obtained by copolymerizing aliphatic hydrocarbon monomers (as disclosed, for example, in Japanese Patent Publication Tokkai 2-68367); (3) those containing a lubricating oil, oil-soluble polymers with Staudinger's viscosity-average molecular weight of 1,000,000-7,000,000 and a surfactant (as disclosed, for example, in Japanese Patent Publication Tokkai 2001-89975); (4) those containing polyether compounds with molecules including 1,2-epoxyalkane with 6-24 carbon atoms or polymerization residual group of alkylene oxide with 2-4 carbon atoms therewith (as disclosed, for example, in Japanese Patent Publication Tokkai 5-9873); and (5) those containing ester compounds with 25 or more carbon atoms obtained from higher aliphatic acid and higher alcohol by 30 weight % or more and an emulsifier with a cloudy point at 40° C. or more and 80° C. or less by 20 weight % or more (as disclosed, for example, in Japanese Patent Publication Tokkai 5-321058).

These agents cannot sufficiently prevent synthetic fibers from becoming electrically charged, however, because their storage stability is poor and hence there are limitations to their practical use. As a result, the problem of uneven dyeing remains at the time of dyeing of the woven articles produced from such synthetic fibers.

SUMMARY OF THE INVENTION

It is therefore an object of this invention to provide a straight-type finish for synthetic fibers which itself is superior in storage stability and is capable of sufficiently preventing synthetic fibers from becoming electrically charged as it is applied thereto and to thereby prevent the occurrence of uneven dyeing, a processing method for false twisted textured yarns using such a finish and false twisted textured yarns obtained by such a method.

This invention is based on the discovery made by the inventors hereof as a result of their diligent studies to solve the problems described above that use should properly be made of a straight-type finish for synthetic fibers comprising a lubricant and a functional improvement agent at specified ratios, the functional improvement agent containing a specified metal organic sulfonate at a specified ratio.

DETAILED DESCRIPTION OF THE INVENTION

The invention relates to a straight-type finish for synthetic fibers comprising a lubricant and a functional improvement agent, containing the lubricant at 70-99.5 mass % of the total and the functional improvement agent at 0.5-30 mass % of the total, and the functional improvement agent including metal organic sulfonate shown by formula 1 at 0.05-15 mass % of the total, formula 1 being:

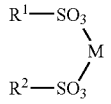

where $R^1$ and $R^2$ are each alkyl group with 1-36 carbon atoms, alkenyl group with 2-24 carbon atoms, phenyl group, alkylphenyl group having alkyl group with 1-36 carbon atoms, naphthyl group, alkyl-naphthyl group having alkyl group with 1-36 carbon atoms, or 1,2-bis(alkyloxycarbonyl)-1-ethane group having alkyl group with 4-24 carbon atoms; and M is a divalent metal.

The invention also relates to a processing method for false twisted textured yarns characterized as attaching the straight-type finish for synthetic fibers of this invention described above at the rate of 0.1-5 mass % with respect to the false twisted textured yarns after the false twisting step.

The invention further relates to false twisted textured yarns obtained by the processing method of this invention described above.

The straight-type finish for synthetic fibers according to this invention (hereinafter referred to simply as the finish of this invention) is described first. The finish of this invention is characterized as comprising a lubricant and a functional improvement agent, the functional improvement agent including metal organic sulfonate shown by formula 1.

In formula 1 describing the metal organic sulfonate, $R^1$ and $R^2$ may either represent the same group or be different groups. They may each be (1) alkyl group with 1-36 carbon atoms such as methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, icosyl group, henicosyl group, docosyl group, tricosyl group, tetracosyl group, pentacosyl group, hexacosyl group, heptacosyl group, octacosyl group, nonacosyl group, triacontyl group, hentriacontyl group, dotriacontryl group, tritriacontyl group, tetratricontyl group, pentatriacontyl group, hexatriacontyl group, 2-methyl-pentyl group, 2-ethyl-hexyl group, 2-propyl-heptyl group, 2-butyl-octyl group, 2-pentyl-nonyl group, 2-hexyl-decyl group, 2-heptyl-undecyl group, 2-octyl-dodecyl group, 2-nonyl-tridecyl group, 2-decyl-tetradecyl group, 2-undecyl-pentadecyl group and 2-dodecyl-hexadecyl group; (2) alkenyl groups with 2-24 carbon atoms such as ethenyl group, propenyl group, butenyl group, pentenyl group, hexenyl group, heptenyl group, octenyl group, nonenyl group, decenyl group, 10-undecenyl group, dodecenyl group, tridecenyl group, tetradecenyl group, pentadecenyl group, hexadecenyl group, heptadecenyl group, 9c-octadecenyl group, 9t-octadecenyl group, 9c,12c-octadecadienyl group, 9c,12c,15c-octadecatrienyl group, 9c-icosenyl group, 5,8,11,14-icosatetraenyl group, 13c-docosenyl group, 13t-docosenyl group, tricosenyl group, and tetracosenyl group; (3) phenyl group; (4) alkyl-phenyl groups having alkyl group with 1-36 carbon atoms such as methyl phenyl group, ethyl phenyl group, propyl phenyl group, butyl phenyl group, hexyl phenyl group, octyl phenyl group, nonyl phenyl group, decyl phenyl group, undecyl phenyl group, dodecyl phenyl group, tetradecyl phenyl group, pentadecyl phenyl group, hexadecyl phenyl group, heptadecyl phenyl group, octadecyl phenyl group, nonadecyl phenyl group, icosyl phenyl group, henicosyl phenyl group, docosyl phenyl group, tricosyl phenyl group, tetracosyl phenyl group, pentacosyl phenyl group, hexacosyl phenyl group, heptacosyl phenyl group, octacosyl phenyl group, nonacosyl phenyl group, triacontyl phenyl group, hentriacontyl phenyl group, dotriacontyl phenyl group, tritriacontyl phenyl group, tetratriacontryl phenyl group, pentatriacontyl phenyl group, hexatriacontyl phenyl group, 2-methyl-pentyl phenyl group, 2-ethyl-hexyl phenyl group, 2-propyl-heptyl phenyl group, 2-butyl-octyl phenyl group, 2-pentyl-nonyl phenyl group, 2-hexyl-decyl phenyl group, 2-heptyl-undecyl phenyl group, 2-octyl-dodecyl phenyl group, 2-nonyl-tridecyl phenyl group, 2-decyl-tetradecyl phenyl group, 2-undecyl-pentadecyl phenyl group and 2-dodecyl-hexadecyl phenyl group; (5) naphthyl group; (6) alkyl naphthyl groups having alkyl group with 1-36 carbon atoms such as methyl naphthyl group, ethyl naphthyl group, propyl naphthyl group, butyl naphthyl group, hexyl naphthyl group, octyl naphthyl group, nonyl naphthyl group, decyl naphthyl group, undecyl naphthyl group, dodecyl naphthyl group, tetradecyl naphthyl group, pentadecyl naphthyl group, hexadecyl naphthyl group, heptadecyl naphthyl group, octadecyl naphthyl group, nonadecyl naphthyl group, icosyl naphthyl group, henicosyl naphthyl group, docosyl naphthyl group, tricosyl naphthyl group, tetracosyl naphthyl group, pentacosyl naphthyl group, hexacosyl naphthyl group, heptacosyl naphthyl group, octacosyl naphthyl group, nonacosyl naphthyl group, triacontyl naphthyl group, hentriacontyl naphthyl group, dotriacontyl naphthyl group, tritriacontyl naphthyl group, tetratriacontyl naphthyl group, pentatriacontyl naphthyl group, hexatriacontyl naphthyl group, 2-methyl-pentyl naphthyl group, 2-ethyl-hexyl naphthyl group, 2-propyl-heptyl naphthyl group, 2-butyl-octyl naphthyl group, 2-pentyl-nonyl naphthyl group, 2-hexyl-decyl naphthyl group, 2-heptyl-undecyl naphthyl group, 2-octyl-dodecyl naphthyl group, 2-nonyl-tridecyl naphthyl group, 2-decyl-tetradecyl naphthyl group, 2-undecyl-pentadecyl naphthyl group and 2-dodecyl-hexadecyl naphthyl group; and (7) 1,2-bis(alkyloxycarbonyl)-1-ethane groups having alkyl group with 4-24 carbon atoms such as 1,2-bis(butyloxycarbonyl)-1-ethane group, 1,2-bis(octyloxycarbonyl)-1-ethane group and 1,2-bis(dodecyloxycarbonyl)-1-ethane group. Among these, alkyl groups with 6-22 carbon atoms, alkyl phenyl groups having alkyl group with 8-18 carbon atoms and alkyl naphthyl groups having alkyl group with 8-18 carbon atoms are preferred.

Regarding the metal organic sulfonate shown by formula 1, M represents a metal with valence 2, or a divalent metal. Examples of M include beryllium, magnesium, calcium, strontium, barium, manganese, iron, radium, cobalt, nickel, copper and zinc. Among these, calcium and magnesium are preferred. The metal organic sulfonate shown by formula 1 may be used either singly or as a mixture of two of more.

The metal organic sulfonates shown by formula 1 themselves may be synthesized by any of the known methods such as disclosed in Japanese Patent Publication Tokkai 2000-204193.

The functional improvement agent that is contained in the finish of this invention besides the metal organic sulfonate shown by formula 1 is to serve as a cohesive agent for bundling synthetic fiber yarns, an auxiliary agent for removing impurities from the synthetic fiber yarns and compatibilizer for uniformizing the metal organic sulfonate shown by formula 1 and the lubricant. Examples of such functional improvement agent include (1) nonionic surfactants of polyoxyalkylene polyol fatty acid ester such as polyoxyalkylene alkylether, polyoxyalkylene alkylphenylether, polyoxyalkylene alkyl esters, polyoxyalkylene castor oil, polyoxyalkylene alkylaminoether sorbitan monolaurate, sorbitan triolate, glycerol monolaurate, diglycerol dilaurate, alkylene oxide adducts of partial ester of trihydric-hexahydric alcohol and fatty acid, partial and complete esters of adducts of trihydric-hexahydric alcohol with alkylene oxide and fatty acid, and alkylene oxide adducts of ester of trihydric-hexahydric alcohol and hydroxyl fatty acid; (2) anionic surfactants such as salts of organic fatty acid and organic phosphates; (3) cationic surfactants such as lauryltrimethylammonium ethosulfate; and (4) amphoteric surfactants such as octyldimethylammonioacetate. Among these, nonionic surfactants are preferred.

Commonly known kinds of lubricant may be used for the finish of this invention. Examples of such lubricant include (1) aliphatic ester compounds such as lauryl oleate, stearyl oleate, oleyl oleate, octyl oleate, tridecyl oleate, methyl oleate, butyl oleate, 2-ethylhexyl oleate, octyl stearate, oleyl stearate, butyl palmitate, oleyl palmitate, oleyle laurate, oleyl isostearate, oleyl octanoate, ethylene glycol dilaurate, propylene glycol distearate, hexanediol dilaurate, glycerol tri-12-hydroxystearate, glycerol trioleate, glycerol palmitate distearate, trimethylol propane tripalmitate, sorbitan tetraoleate, pentaerithritol tetralaurate, distearyl succinate, distearyl glutarate, dicetyl adipate, dibehenyl pymerate, dibehenyl pimerate, dibehenyl suberate, distearyl azelate and distearyl sebasate; (2) mineral oils of various kinds having various viscosity; (3) linear polydimethyl siloxanes having various viscosity and linear polyorganosiloxanes having various viscosity obtained by modifying such linear polydimethyl siloxanes with ethyl group, phenyl group, fluoropropyl group, aminopropyl group, carboxyoctyl group, polyoxyethylene oxypropyl group or co-methoxypolyethoxy-polypropoxypropyl group; (4) polyether compounds such as polyether monools, polyether diols and polyether triols having polyoxyalkylene group; (5) aromatic ester compounds such as benzyl stearate, benzyl laurate, diisostearyl isophtharate and trioctyl trimellitate; and (6) (poly)etherester compounds such as (poly)etherester compound obtained from (poly)ether compound with alkylene oxide with 2-4 carbon atoms added to monohydric-trihydric aliphatic alcohol with 4-26 carbon atoms and aliphatic carboxylic acid with 4-26 carbon atoms, (poly)etherester compound obtained from (poly)ether compound with alkylene oxide with 2-4 carbon atoms added to monohydric-trihydric aromatic alcohol and aliphatic carboxylic acid with 4-26 carbon atoms, and (poly)etherester compound obtained from (poly)ether compound with alkylene oxide with 2-4 carbon atoms added to aliphatic alcohol with 4-26 carbon atoms and aromatic carboxylic acid. Among these, aliphatic ester compounds, mineral oils and linear polyorgano siloxanes are preferred as the lubricant, and aliphatic ester compounds with 17-60 carbon atoms obtained from aliphatic monohydric alcohol and aliphatic monocarboxylic acid, aliphatic complete ester compounds with 17-60 carbon atoms obtained from aliphatic polyhydric alcohol and aliphatic monocarboxylic acid, aliphatic ester compounds with 17-60 carbon atoms such as aliphatic partial ester compounds with 17-60 carbon atoms obtained from aliphatic polyhydric alcohol and aliphatic monocarboxylic acid, mineral oils with viscosity of $2\times10^{-6}$- $2\times10^{-4}$ $m^2/s$ at 30° C. and linear polydimethyl siloxane with viscosity of $1\times10^{-6}$-$2\times10^{-3}$ $m^2/s$ at 30° C. are more preferable. Such lubricants may be used either singly or as a mixture of two or more.

The finish of this invention comprises a lubricant as described above and a functional improvement agent containing metal organic sulfonate shown by formula 1, the lubricant being contained at a rate of 70-99.5 mass % and preferably 70-90 mass % of the total, the functional improvement agent containing metal organic sulfonate shown by formula 1 being contained at a rate of 0.5-30 mass % and preferably 10-30 mass % of the total, and the metal organic sulfonate shown by formula 1 being contained at a ratio of 0.05-15 mass % and preferably 1-10 mass % of the total.

When the finish of this invention is applied to synthetic fibers, an appearance control agent, an antioxidant agent, a heat-resisting agent, a defoamer, a biocide, an antirust agent, etc. may also be used in addition but their amount should be as small as possible.

Next, the method of processing false twisted textured yarns of this invention (hereinafter referred to as the processing method of this invention) is explained. The processing method of this invention comprises a method of applying the finish of this invention described above at a rate of 0.1-5 mass % with respect to the false twisted textured yarns after they have undergone the false twisting step.

According to the processing method of this invention, the finish of this invention is applied by neat oiling by a conventional method such as the roller oiling method, the guide oiling method using a metering pump, the dip oiling method and the spray oiling method at a rate of 0.1-5 mass % and preferably 0.5-3 mass % with respect to the false twisted textured yarns after they have undergone the false twisting step.

There is no particular limitation on the condition of the false twisting step. Since the heaters that are used for the false twisting may be of a contact type or a non-contact type and their combination may be of the single-step type or the double-step type, the process may be carried out in various combinations. If a heater of the contact type is used, its surface temperature is usually 70-240° C. and preferably 100-220° C. If a heater of the non-contact type is used, its surface temperature is usually 100-600° C. and preferably 150-500° C. In either case, the processing speed is usually 100-1500 m/minute and preferably 200-1200 m/minute. Although the process may be carried out under any condition in these ranges, it is preferable for the purpose of the invention to carry out the false twisting by using heaters of the contact type with surface temperature 100-220° C. at processing speed of 200-1200 m/minute.

Lastly, false twisted textured yarns of synthetic fibers according to this invention (hereinafter referred to as the false twisted textured yarns of this invention) will be described. The false twisted textured yarns of this invention are characterized as being produced by the processing method of this invention.

Examples of synthetic fibers for the false twisted textured yarns of this invention include (1) polyester synthetic fibers such as polyethylene terephtharate, polypropylene terephtharate, polybutylene terephtharate and polytetraethylene terephtharate; (2) polyamide synthetic fibers such as nylon 6 and nylon 6,6; (3) polyacrylic synthetic fibers such as polyacrylic and modacrylic; (4) polyolefin synthetic fibers such as polyethylene and polypropylene; (5) polyurethane synthetic fibers, and (6) polylactic acid synthetic fibers. Effects of the present invention are more prominently visible when applied to polyester, polyamide or polylactic acid synthetic fibers.

The finish of this invention is superior in its storage characteristics, being capable of sufficiently preventing synthetic fibers from becoming electrically charged as it is applied thereto and hence the occurrence of uneven dyeing when woven articles produced from such synthetic fibers are dyed.

Test examples are shown in what follows in order to describe the invention more clearly but these examples are not intended to limit the scope of the invention. In the following test and comparison examples, "part" will means "mass part" and "%" will mean "mass %".

TEST EXAMPLES

Part 1

Synthesis of Metal Organic Sulfonates Shown by Formula 1

Synthesis of Metal Organic Sulfonate (S-1)

Propylsulfonic acid (248 parts, 2.0 mol) and deionized water (1000 parts) were charged into a 4-neck flask with flush bottom outlet valves equipped with a thermometer, a stirrer and a reflux condenser and the mixture was stirred with heating for dissolving. While this solution was stirred thereafter, calcium hydroxide (74 parts, 1.0 mol) was added thereto over a period of ten minutes and after its temperature was raised to 70-90° C., a neutralization reaction was carried out at this temperature by stirring for one hour. After the stirring was stopped, it was left quietly for 30 minutes to separate the lower layer portion containing deposited calcium salt of propylsulfonic acid. Water (500 parts) was added to the portion containing the calcium salt of propylsulfonic acid. After it was heated to 70-90° C. and stirred for one hour, the stirring was stopped and it was left quietly for three hours at the same temperature. After the upper layer of aqueous solution was removed from the top by leaving the lower layer portion, it was washed with water. A similar washing process with water was repeated once more and calcium salt of propylsulfonic acid (257 parts, 0.9 mol) was obtained by dehydration and drying. This was collected as metal organic sulfonate (S-1).

Synthesis of Metal Organic Sulfonates (S-2)-(S-35) and (T-1)-(T-3)

Metal organic sulfonats (S-2)-(S-35) and (T-1)-(T-3) in Table 1 below were synthesized similarly as described above.

TABLE 1

Metal organic sulfonates

| Kind | $R^1$ Kind | $R^2$ Kind | M |
|---|---|---|---|
| S-1 | propyl group | propyl group | magnesium |
| S-2 | hexyl group | hexyl group | magnesium |
| S-3 | nonyl group | decyl group | calcium |
| S-4 | dodecyl group | dodecyl group | calcium |
| S-5 | tetradecyl group | pentadecyl group | calcium |
| S-6 | octadecyl group | docosyl group | calcium |
| S-7 | octacosyl group | octacosyl group | barium |
| S-8 | triacontyl group | triacontyl group | barium |
| S-9 | hexatriacontyl group | hexatriacontyl group | magnesium |
| S-10 | hexenyl group | hexenyl group | manganese |
| S-11 | decenyl group | decenyl group | calcium |
| S-12 | tetradecenyl group | hexadecenyl group | calcium |
| S-13 | octadecenyl group | octadecenyl group | iron |
| S-14 | 13c-docosenyl group | 13t-docosenyl group | calcium |
| S-15 | phenyl group | phenyl group | cobalt |
| S-16 | propyl phenyl group | propyl phenyl group | copper |
| S-17 | octyl phenyl group | octyl phenyl group | calcium |
| S-18 | decyl phenyl group | decyl phenyl group | calcium |
| S-19 | dodecyl phenyl group | octadecyl phenyl group | calcium |
| S-20 | tetradecyl group | hexadecyl phenyl group | magnesium |
| S-21 | octadecyl phenyl group | dodecyl phenyl group | magnesium |
| S-22 | octacosyl phenyl group | octacosyl phenyl group | magnesium |
| S-23 | triacontyl phenyl group | triacontyl phenyl group | magnesium |
| S-24 | hexatriacontyl phenyl group | hexatriacontyl phenyl group | magnesium |
| S-25 | naphthyl group | naphthyl group | calcium |
| S-26 | propyl naphthyl group | propyl naphthyl group | magnesium |
| S-27 | hexyl naphthyl group | diisopropyl naphthyl group | magnesium |
| S-28 | octyl naphtyl group | nonyl naphtyl group | magnesium |
| S-29 | dodecyl naphtyl group | decyl naphtyl group | calcium |
| S-30 | tetradecyl naphthyl group | pentadecyl naphthyl group | calcium |
| S-31 | octadecyl naphthyl group | octadecyl naphthyl group | calcium |
| S-32 | triacontyl naphthyl group | triacontyl naphthyl group | zinc |
| S-33 | hexatriacontyl naphtyl group | hexatriacontyl naphtyl group | magnesium |
| S-34 | 1,2-bis(octyloxycarbonyl)-1-ethane group | 1,2-bis(octyloxycarbonyl)-1-ethane group | calcium |
| S-35 | 1,2-bis(dodecyloxycarbonyl)-1-ethane group | 1,2-bis(dodecyloxycarbonyl)-1-ethane group | magnesium |
| T-1 | dodecyl group | dodecyl group | Sodium |
| T-2 | dodecyl phenyl group | dodecyl phenyl group | Sodium |
| T-3 | dodecyl naphthyl group | dodecyl naphthyl group | Potassium |

In Table 1, $R^1$, $R^2$ and M correspond to $R^1$, $R^2$ and M in formula 1.

Part 2

Preparation of Finishes

Test Example 1

Preparation of Finish (P-1)

Mineral oil (A-1) with viscosity at 30° C. of $3.5\times10^{-5}$ $m^2/s$ (82 parts) and metal organic sulfonate (S-1) synthesized in Part 1 (5 parts) were dissolved as lubricant at 60° C. with heating and stirring. After it was ascertained by visual observation that they were completely dissolved, α-dodecyl-ω-hydroxypoly(oxyethylene) (n=15) (B-1) (13 parts) was mixed and dissolved with stirring as a functional improvement agent other than metal organic sulfonate and the mixture was further stirred for one hour. After the stirring was stopped, it was cooled at a normal temperature to obtain finish (P-1).

Test Examples 2-35 and Comparison Examples 1-10

Preparation of Finishes (P-2)-(P-35) and (R-1)-(R-10)

Finishes (P-2)-(P-35) and (R-1)-(R-10) were similarly synthesized. Details of each example are shown in Tables 2 and 3.

Part 3

Evaluation of Storage Stability

After each of the finishes prepared in Part 2 was placed in a transparent beaker and left quietly for seven days at a normal temperature, the external appearance was observed visually and judged according to the following standards. The results are shown also in Tables 2 and 3.

A: External appearance is uniform and transparent

B: External appearance is not uniform and some white turbidity was observed

C: White turbidity was prominent or separation of liquid phase was observed

TABLE 2

| Test Example | Kind of finish | Functional improvement agent: Lubricant Kind | Lubricant Ratio (%) | Metal organic sulfonate Kind | Metal organic sulfonate Ratio (%) | Others Kind | Others Ratio (%) | Storage stability |
|---|---|---|---|---|---|---|---|---|
| 1 | P-1 | A-1 | 82 | S-1 | 5 | B-1 | 13 | A |
| 2 | P-2 | A-2 | 82 | S-2 | 5 | B-2 | 13 | A |
| 3 | P-3 | A-3 | 82 | S-3 | 5 | B-3 | 13 | A |
| 4 | P-4 | A-1 | 82 | S-4 | 5 | B-1 | 13 | A |
| 5 | P-5 | A-2 | 82 | S-5 | 5 | B-2 | 13 | A |
| 6 | P-6 | A-3 | 82 | S-6 | 5 | B-3 | 13 | A |
| 7 | P-7 | A-4 | 84 | S-7 | 0.5 | B-1 | 13 | A |
| | | | | | | B-4 | 2.5 | |
| 8 | P-8 | A-5 | 84 | S-8 | 0.5 | B-1 | 13 | A |
| | | | | | | B-5 | 2.5 | |
| 9 | P-9 | A-6 | 94 | S-9 | 0.5 | B-2 | 3 | A |
| | | | | | | B-4 | 2.5 | |
| 10 | P-10 | A-1 | 94 | S-10 | 0.5 | B-2 | 3 | A |
| | | | | | | B-5 | 2.5 | |
| 11 | P-11 | A-2 | 72 | S-11 | 13 | B-2 | 14 | A |
| | | | | | | B-6 | 1 | |
| 12 | P-12 | A-3 | 72 | S-12 | 13 | B-3 | 14 | A |
| | | | | | | B-4 | 1 | |
| 13 | P-13 | A-4 | 72 | S-13 | 13 | B-1 | 14 | A |
| | | | | | | B-5 | 1 | |

TABLE 2-continued

| Test Example | Kind of finish | Functional improvement agent: Lubricant Kind | Lubricant Ratio (%) | Metal organic sulfonate Kind | Metal organic sulfonate Ratio (%) | Others Kind | Others Ratio (%) | Storage stability |
|---|---|---|---|---|---|---|---|---|
| 14 | P-14 | A-5 | 76 | S-14 | 8 | B-2 | 14 | A |
| | | | | | | B-4 | 2 | |
| 15 | P-15 | A-6 | 76 | S-15 | 8 | B-3 | 13 | A |
| | | | | | | B-5 | 3 | |
| 16 | P-16 | A-1 | 76 | S-16 | 8 | B-1 | 13 | A |
| | | | | | | B-6 | 3 | |
| 17 | P-17 | A-1 | 79 | S-17 | 8 | B-1 | 13 | A |
| 18 | P-18 | A-2 | 82 | S-18 | 5 | B-1 | 13 | A |
| 19 | P-19 | A-2 | 82 | S-19 | 5 | B-2 | 13 | A |
| 20 | P-20 | A-1 | 82 | S-20 | 5 | B-3 | 13 | A |
| 21 | P-21 | A-2 | 79 | S-21 | 8 | B-1 | 13 | A |
| 22 | P-22 | A-3 | 94 | S-22 | 2 | B-2 | 3 | A |
| | | | | | | B-4 | 1 | |
| 23 | P-23 | A-4 | 94 | S-23 | 2 | B-1 | 3 | A |
| | | | | | | B-5 | 1 | |
| 24 | P-24 | A-5 | 94 | S-24 | 2 | B-1 | 3 | A |
| | | | | | | B-6 | 1 | |
| 25 | P-25 | A-6 | 88 | S-25 | 5 | B-1 | 5 | A |
| | | | | | | B-4 | 2 | |
| 26 | P-26 | A-1 | 88 | S-26 | 5 | B-1 | 5 | A |
| | | | | | | B-5 | 2 | |
| 27 | P-27 | A-2 | 76 | S-27 | 8 | B-1 | 13 | A |
| | | | | | | B-6 | 3 | |
| 28 | P-28 | A-1 | 82 | S-28 | 5 | B-1 | 13 | A |
| 29 | P-29 | A-1 | 82 | S-29 | 5 | B-2 | 13 | A |
| 30 | P-30 | A-2 | 82 | S-30 | 5 | B-2 | 13 | A |
| 31 | P-31 | A-2 | 82 | S-31 | 5 | B-3 | 13 | A |
| 32 | P-32 | A-3 | 82 | S-32 | 5 | B-2 | 13 | A |
| 33 | P-33 | A-3 | 82 | S-33 | 5 | B-3 | 13 | A |
| 34 | P-34 | A-4 | 82 | S-34 | 5 | B-1 | 13 | A |
| 35 | P-35 | A-4 | 82 | S-35 | 5 | B-1 | 13 | A |

TABLE 3

| Comparison Example | Kind of finish | Functional improvement agent: Lubricant Kind | Lubricant Ratio (%) | Metal organic sulfonate Kind | Metal organic sulfonate Ratio (%) | Others Kind | Others Ratio (%) | Storage stability |
|---|---|---|---|---|---|---|---|---|
| 1 | R-1 | A-1 | 80 | T-1 | 5 | B-1 | 15 | C |
| 2 | R-2 | A-1 | 80 | T-2 | 5 | B-4 | 15 | C |
| 3 | R-3 | A-1 | 80 | T-3 | 5 | B-5 | 15 | C |
| 4 | R-4 | A-1 | 99.7 | S-4 | 0.01 | B-4 | 0.29 | B |
| 5 | R-5 | A-1 | 100 | — | — | — | — | A |
| 6 | R-6 | — | — | S-4 | 15 | B-1 | 55 | B |
| | | | | | | B-4 | 10 | |
| | | | | | | B-5 | 20 | |
| 7 | R-7 | A-1 | 30 | S-4 | 20 | B-1 | 20 | C |
| | | | | | | B-4 | 10 | |
| | | | | | | B-6 | 20 | |
| 8 | R-8 | A-1 | 70 | S-2 | 29 | B-1 | 1 | C |
| 9 | R-9 | A-1 | 80 | — | — | B-2 | 20 | C |
| 10 | R-10 | A-1 | 50 | S-2 | 15 | B-3 | 35 | C |

In Tables 2 and 3:

A-1: Mineral oil with viscosity at 30° C. of $3.5\times10^{-5}$ $m^2/s$

A-2: Isopropyl palmitate

A-3: Polydimethyl siloxan with viscosity at 30° C. of $7.0\times10$ $m^2/s$

A-4: Ester compound of α-butyl-ω-hydroxypoly(oxyethylene) (n=3) and dodecanoic acid A-5: Benzyl laurate A-6: Polyether monool with number average molecular weight of 1000 having ethylene oxide and propylene oxide in random addition at mass ratio of 65/35 to butyl alcohol B-1: α-dodecyl-ω-hydroxypoly(oxyethylene) (n=15) (nonionic surfactant)

B-2: 20 mols ethylene oxide adduct of castor oil (nonionic surfactant)

B-3: Glycerol monolaurate (nonionic surfactant)

B-4: Potassium salt of phosphoric acid ester of α-lauryl-ω-hydroxy dioxyethyene (anionic surfactant)

B-5: Lauryl trimethylammonium ethosulfate (cationic surfactant)

B-6: Octyl dimethylammonioacetate (amphoteric surfactant)

Part 4

Production and Treatment of False Twisted Textured Yarns (A) Production and treatment of polyethylene terephtharate false twisted textured yarns After polyethylene terephtharate chips with intrinsic viscosity 0.64 and containing titanium dioxide by 0.2% were dried by a known method, they were spun at 295° C. by using an extruder. After a 10% aqueous solution of a spinning lubricant for synthetic fibers (product name of DELION F-168 produced by Takemoto Yushi Kabushiki Kaisha) was caused to be attached to the running filaments obtained from its spinneret and cooled to become solid by the guide oiling method using a metering pump such that the attached quantity of spinning lubricant became 0.3%, they were collected by a guide and wound up at a speed of 3000 m/minute without mechanical drawing to obtain 128 dtex, 36-filament partially oriented yarns as a 10-kg wound cake. A false twisting process was carried out by using this cake with a false twister with a contact heater (product name of SDS1200 produced by TEIJIN SEIKI CO., LTD.) at a speed of 700 m/minute. The conditions of this process were as follows: draw ratio=1.525; twisting system=one guide disk on entrance side, one guide disk on exit side and four hard polyurethane disks; length and surface temperature of heater on twist side=2.5 m and 212° C.; heater on untwist side=none, and number of twists=3300 T/m. At the time of this false twisting process, a neat oiling process was carried out on the false twisted textured yarns prior to being wound around a paper tube by a roller oiling method such that the amount shown in Table 4 of the finish (P-1) prepared in Part 2 would become attached so as to obtain polyethylene terephtharate false twisted textured yarns of Test Example 36. Similarly, polyethylene terephtharate false twisted textured yarns of Test Examples 37-72 and Comparison Examples 11-20 were obtained. Details of each example are shown in Table 4.

(B) Production and Treatment of Nylon 6,6 False Twisted Textured Yarns

After nylon 6,6 chips with sulfuric acid relative viscosity (ηr) 2.4 and containing titanium dioxide by 0.1% were dried by a known method, they were spun at 290° C. by using an extruder. After a 10% aqueous solution of a spinning lubricant for synthetic fibers (product name of DELION F-168 produced by Takemoto Yushi Kabushiki Kaisha) was caused to be attached to the running filaments obtained from its spinneret and cooled to become solid by the guide oiling method using a metering pump such that the attached quantity of spinning lubricant became 0.4%, they were collected by a guide and wound up at a speed of 4000 m/minute without mechanical drawing to obtain 70 dtex, 24-filament partially oriented yarns as a 10-kg wound cake. A false twisting process was carried out by using this cake with a false twister with a contact heater (product name of SDS1200 produced by TEIJIN SEIKI CO., LTD.) at a speed of 700 m/minute. The conditions of this process were as follows: draw ratio=1.220; twisting system=one guide disk on entrance side, one guide disk on exit side and four hard polyurethane disks; length and surface temperature of heater on twist side=2.5 m and 230° C.; heater on untwist side=none, and number of twists=3000 T/m. At the time of this false twisting process, a neat oiling process was carried out on the false twisted textured yarns prior to being wound around a paper tube by a roller oiling method such that the amount shown in Table 5 of the finish (P-1) prepared in Part 2 would become attached so as to obtain nylon 6,6 false twisted textured yarns of Test Example 73. Similarly, polyethylene terephtharate false twisted textured yarns of Test Examples 74-109 and Comparison Examples 21-30 were obtained. Details of each example are shown in Table 5.

(C) Production and Treatment of Polylactic Acid False Twisted Textured Yarns

Lactic polymer chips with average molecular weight of 120000, melt flow rate of 25 g/10 minutes (210°), glass transition temperature of 60° C. and specific gravity of 1.26 were spun at 210° C. by using an extruder. After a 10% aqueous solution of a spinning lubricant for synthetic fibers (product name of DELION F-168 produced by Takemoto Yushi Kabushiki Kaisha) was caused to be attached to the running filaments obtained from its spinneret and cooled to become solid by the guide oiling method using a metering pump such that the attached quantity of spinning lubricant became 0.5%, they were collected by a guide and wound up at a speed of 3800 m/minute by carrying out mechanical drawing to obtain 100 dtex, 36-filament drawn yarns as a 10-kg wound cake. The tensile strength and elongation of the obtained drawn yarns were respectively 4.6 g/dtx and 30%. A false twisting process was carried out by using this cake with a false twister with a contact heater (product name of SDS1200 produced by TEIJIN SEIKI CO., LTD.) at a speed of 500 m/minute. The conditions of this process were as follows: draw ratio=1.25; twisting system=one guide disk on entrance side, one guide disk on exit side and four hard polyurethane disks; length and surface temperature of heater on twist side=2.5 m and 130° C.; heater on untwist side=none, and number of twists=2500 T/m. At the time of this false twisting process, a neat oiling process was carried out on the false twisted textured yarns prior to being wound around a paper tube by a roller oiling method such that the amount shown in Table 6 of the finish (P-1) prepared in Part 2 would become attached so as to obtain polylactic acid false twisted textured yarns of Test Example 110. Similarly, polylactic acid false twisted textured yarns of Test Examples 111-146 and Comparison Examples 31-40 were obtained. Details of each example are shown in Table 6.

Part 5

Evaluation of False Twisted Textured Yarns

Each of the false twisted textured yarns produced and treated in Part 4 was used as follows to measure the attached amount of the finish and its antistatic and dyeing characteristics were evaluated. The results are shown in Tables 4-6.

Measurement of Attached Amount of finish

Attached amount of finish was measured for each example of false twisted textured yarns according to JIS-L1073 (Testing methods for man-made filament yarns) by using a mixed solvent of normal hexane/ethanol (volume ratio of 50/50) as the extracting solvent.

Evaluation of Antistatic Characteristics

For this evaluation, 100 false twisted textured yarns of each example were hung on a warping machine, arranged in creels, and wound up as a warp beam of 10000 m at the speed of 100 m/minute. At this moment, the electricity generated by the friction with the metal was measured by means of a KASUGA DENKI current-collecting potential meter and the results were evaluated according to the following standards:

A: Charge voltage was lower than 0.1 kV

B: Charge voltage was 0.1 kV or higher and lower than 0.5 kV

C: Charge voltage was 0.5 kV or higher and lower than 1.0 kV

D: Charge voltage was 1.0 kV or higher and lower than 2.0 kV

E: Charge voltage was 2.0 kV or higher

Evaluation of Dyeing Characteristics of Polyethylene Terephtharate False Twisted Textured Yarns The polyethylene terephtharate false twisted textured yarns wound on the warping machine as described above for the evaluation of antistatic characteristics were subjected to sizing and drying operations and prepared for warping and passed through a sley of a water-jet loom. A plain woven article was prepared by passing the obtained polyethylene terephtharate false twisted textured yarns through the wefts. After this plain woven article was refined at 80° C. for relaxation, a disperse dye (product name of Kayalon Polyester Blue EBL-E produced by Nippon Kayaku Co., Ltd.) was used for dyeing by the high-pressure dyeing method. The dyed plain woven article was washed with water by a known method and after it was subjected to a reduction cleaning process and dried, it was set on a tube made of iron with diameter 70 mm and length 1 m to repeat for five times an evaluation process of visually counting the number of spots of deep dyeing on the surface of the plain woven article. The number of points on each sheet per sheet of plain woven article was obtained from the evaluation results. The results were evaluated according to the following standards:

A: The surface of the plain woven article was in a uniform plain woven condition and there was no dyeing lines B: The surface of the plain woven article was in a uniform plain woven condition but there was one dyeing line C: The surface of the plain woven article was in a uniform plain woven condition and there were 2-3 dyeing lines D: The surface of the plain woven article was in a non-uniform plain woven condition and there were 3-10 dyeing lines E: The surface of the plain woven article was in a non-uniform plain woven condition and there were ten or more dyeing lines with clear lengths over the surface Evaluation of Dyeing Characteristics of Nylon 6,6 False Twisted Textured Yarns The nylon 6,6 false twisted textured yarns wound on the warping machine as described above for the evaluation of antistatic characteristics were subjected to sizing and drying operations and prepared for warping and passed through a sley of a water-jet loom. A plain woven article was prepared by passing the obtained nylon 6,6 false twisted textured yarns through the wefts. After this plain woven article was refined at 80° C. for relaxation, an acid dye (product name of Sandolan Blue E-HRLN produced by Clariant) was used for dyeing by the normal pressure dyeing method. The dyed plain woven article was washed with water by a known method and after it was dried, it was set on a tube made of iron with diameter 70 mm and length 1 m to repeat for five times an evaluation process of visually counting the number of spots of deep dyeing on the surface of the plain woven article. The number of points on each sheet per sheet of plain woven article was obtained from the evaluation results. The results were evaluated according to similar standards as for the evaluation of the dyeing condition of polyethylene terephtharate false twisted textured yarns.

Evaluation of Dyeing Characteristics of Polylactic Acid False Twisted Textured Yarns The polylactic acid false twisted textured yarns wound on the warping machine as described above for the evaluation of antistatic characteristics were subjected to sizing and drying operations and prepared for warping and passed through a sley of a water-jet loom. A plain woven article was prepared by passing the obtained polylactic acid false twisted textured yarns through the wefts. After this plain woven article was refined at 90° C. for relaxation, a disperse dye (product name of Kayalon Polyester Blue EBL-E produced by Nippon Kayaku Co., Ltd.) was used for dyeing by a dyeing method under the processing conditions of 100° C. and 40 minutes. The dyed plain woven article was washed with water by a known method and after it was subjected to a reduction cleaning processed and dried, it was set on a tube made of iron with diameter 70 mm and length 1 m to repeat for five times an evaluation process of visually counting the number of spots of deep dyeing on the surface of the plain woven article. The number of points on each sheet per sheet of plain woven article was obtained from the evaluation results. The results were evaluated according to similar standards as for the evaluation of the dyeing condition of polyethylene terephtharate false twisted textured yarns.

TABLE 4

| | Kind of finish | Heater surface temperature (° C.) | Fabrication speed (m/minute) | Attached amount (%) | Antistatic characteristic | Dyeing characteristic |
|---|---|---|---|---|---|---|
| Test Example | | | | | | |
| 36 | P-1 | 212 | 700 | 2.2 | B | B |
| 37 | P-2 | 212 | 700 | 0.7 | A | A |
| 38 | P-3 | 212 | 700 | 1.3 | A | A |
| 39 | P-4 | 212 | 700 | 2.0 | A | A |
| 40 | P-5 | 212 | 700 | 1.9 | A | A |
| 41 | P-6 | 212 | 700 | 2.6 | A | A |
| 42 | P-7 | 212 | 700 | 1.8 | C | C |
| 43 | P-8 | 212 | 500 | 2.3 | C | C |
| 44 | P-9 | 212 | 500 | 0.4 | C | C |
| 45 | P-10 | 212 | 700 | 2.6 | C | C |
| 46 | P-11 | 212 | 800 | 1.8 | B | C |
| 47 | P-12 | 200 | 500 | 1.2 | B | C |
| 48 | P-13 | 200 | 500 | 2.2 | B | C |
| 49 | P-14 | 190 | 500 | 2.1 | B | B |

TABLE 4-continued

| | Kind of finish | Heater surface temperature (° C.) | Fabrication speed (m/minute) | Attached amount (%) | Antistatic characteristic | Dyeing characteristic |
|---|---|---|---|---|---|---|
| 50 | P-15 | 190 | 500 | 2.4 | B | B |
| 51 | P-16 | 200 | 500 | 2.3 | B | B |
| 52 | P-17 | 200 | 800 | 2.7 | A | A |
| 53 | P-18 | 200 | 800 | 1.8 | A | A |
| 54 | P-19 | 200 | 800 | 2.0 | A | A |
| 55 | P-20 | 200 | 900 | 1.2 | A | A |
| 56 | P-21 | 200 | 1000 | 0.9 | A | A |
| 57 | P-22 | 200 | 1000 | 1.2 | B | B |
| 58 | P-23 | 225 | 1000 | 1.8 | B | B |
| 59 | P-24 | 225 | 1000 | 2.7 | B | B |
| 60 | P-25 | 190 | 900 | 3.5 | B | B |
| 61 | P-26 | 190 | 900 | 3.0 | B | B |
| 62 | P-27 | 190 | 900 | 2.6 | B | B |
| 63 | P-28 | 190 | 600 | 0.8 | A | A |
| 64 | P-29 | 200 | 700 | 2.0 | A | A |
| 65 | P-30 | 180 | 700 | 2.7 | A | A |
| 66 | P-31 | 180 | 900 | 1.5 | A | A |
| 67 | P-32 | 210 | 1200 | 1.3 | B | B |
| 68 | P-33 | 210 | 1200 | 1.8 | B | B |
| 69 | P-34 | 210 | 1200 | 4.0 | B | B |
| 70 | P-35 | 210 | 1200 | 0.8 | B | B |
| 71 | P-1 | 210 | 300 | 0.5 | C | B |
| 72 | P-4 | 210 | 800 | 4.6 | A | B |
| Comparison Example | | | | | | |
| 11 | R-1 | 210 | 800 | 1.9 | E | E |
| 12 | R-2 | 210 | 800 | 2.2 | E | E |
| 13 | R-3 | 210 | 800 | 2.4 | E | E |
| 14 | R-4 | 210 | 800 | 2.3 | D | E |
| 15 | R-5 | 210 | 800 | 2.2 | E | E |
| 16 | R-6 | 210 | 800 | 2.3 | E | E |
| 17 | R-7 | 210 | 800 | 2.0 | C | D |
| 18 | R-8 | 210 | 800 | 1.9 | D | E |
| 19 | R-9 | 210 | 800 | 2.0 | E | E |
| 20 | R-10 | 210 | 800 | 2.5 | E | E |

TABLE 5

| | Kind of finish | Heater surface temperature (° C.) | Fabrication speed (m/minute) | Attached amount (%) | Antistatic characteristic | Dyeing characteristic |
|---|---|---|---|---|---|---|
| Test Example | | | | | | |
| 73 | P-1 | 230 | 700 | 1.9 | B | B |
| 74 | P-2 | 210 | 700 | 2.1 | A | A |
| 75 | P-3 | 210 | 700 | 1.2 | A | A |
| 76 | P-4 | 210 | 800 | 2.1 | A | A |
| 77 | P-5 | 210 | 800 | 0.8 | A | A |
| 78 | P-6 | 210 | 800 | 2.6 | A | A |
| 79 | P-7 | 230 | 800 | 0.8 | C | C |
| 80 | P-8 | 230 | 300 | 0.4 | C | C |
| 81 | P-9 | 210 | 500 | 2.0 | C | C |
| 82 | P-10 | 210 | 500 | 0.3 | C | C |
| 83 | P-11 | 210 | 800 | 3.3 | B | C |
| 84 | P-12 | 220 | 800 | 2.7 | B | C |
| 85 | P-13 | 180 | 600 | 1.5 | B | C |
| 86 | P-14 | 180 | 600 | 0.8 | B | B |
| 87 | P-15 | 180 | 600 | 1.2 | B | B |
| 88 | P-16 | 180 | 600 | 1.8 | B | B |
| 89 | P-17 | 180 | 600 | 2.9 | A | A |
| 90 | P-18 | 190 | 600 | 2.0 | A | A |
| 91 | P-19 | 190 | 800 | 2.7 | A | A |
| 92 | P-20 | 180 | 700 | 1.0 | A | A |
| 93 | P-21 | 200 | 800 | 1.6 | A | A |
| 94 | P-22 | 225 | 900 | 2.6 | B | B |
| 95 | P-23 | 180 | 900 | 0.8 | C | C |
| 96 | P-24 | 225 | 700 | 0.4 | C | C |
| 97 | P-25 | 225 | 900 | 3.2 | B | C |
| 98 | P-26 | 225 | 900 | 1.2 | B | B |
| 99 | P-27 | 225 | 900 | 2.2 | B | B |

TABLE 5-continued

| | Kind of finish | Heater surface temperature (° C.) | Fabrication speed (m/minute) | Attached amount (%) | Antistatic characteristic | Dyeing characteristic |
|---|---|---|---|---|---|---|
| 100 | P-28 | 190 | 700 | 1.7 | A | A |
| 101 | P-29 | 200 | 700 | 1.9 | A | A |
| 102 | P-30 | 180 | 700 | 2.6 | A | A |
| 103 | P-31 | 200 | 900 | 0.8 | A | A |
| 104 | P-32 | 225 | 1200 | 2.3 | B | B |
| 105 | P-33 | 225 | 1200 | 2.1 | B | B |
| 106 | P-34 | 225 | 1200 | 2.2 | B | B |
| 107 | P-35 | 225 | 1200 | 2.1 | B | B |
| 108 | P-1 | 190 | 180 | 0.6 | C | C |
| 109 | P-4 | 210 | 700 | 4.5 | A | B |
| Comparison Example | | | | | | |
| 21 | R-1 | 220 | 800 | 2.2 | E | E |
| 22 | R-2 | 220 | 800 | 2.2 | E | E |
| 23 | R-3 | 220 | 800 | 2.4 | E | E |
| 24 | R-4 | 220 | 800 | 1.8 | D | E |
| 25 | R-5 | 220 | 800 | 2.2 | E | E |
| 26 | R-6 | 220 | 800 | 2.0 | E | E |
| 27 | R-7 | 220 | 800 | 2.2 | D | D |
| 28 | R-8 | 220 | 800 | 2.0 | E | E |
| 29 | R-9 | 220 | 800 | 2.2 | E | E |
| 30 | R-10 | 220 | 800 | 1.7 | E | E |

TABLE 6

| | Kind of finish | Heater surface temperature (° C.) | Fabrication speed (m/minute) | Attached amount (%) | Antistatic characteristic | Dyeing characteristic |
|---|---|---|---|---|---|---|
| Test Example | | | | | | |
| 110 | P-1 | 130 | 500 | 2.0 | B | B |
| 111 | P-2 | 130 | 600 | 0.9 | A | A |
| 112 | P-3 | 130 | 500 | 1.2 | A | A |
| 113 | P-4 | 130 | 600 | 2.3 | A | A |
| 114 | P-5 | 130 | 500 | 2.7 | A | A |
| 115 | P-6 | 130 | 600 | 0.8 | A | A |
| 116 | P-7 | 130 | 500 | 0.3 | C | C |
| 117 | P-8 | 130 | 500 | 1.3 | C | C |
| 118 | P-9 | 120 | 400 | 2.0 | C | C |
| 119 | P-10 | 100 | 400 | 0.8 | C | C |
| 120 | P-11 | 110 | 400 | 2.7 | B | C |
| 121 | P-12 | 80 | 300 | 1.2 | B | C |
| 122 | P-13 | 130 | 500 | 1.2 | B | C |
| 123 | P-14 | 140 | 600 | 2.4 | B | B |
| 124 | P-15 | 140 | 500 | 3.1 | B | B |
| 125 | P-16 | 140 | 600 | 2.8 | B | B |
| 126 | P-17 | 130 | 600 | 2.7 | A | A |
| 127 | P-18 | 140 | 600 | 1.2 | A | A |
| 128 | P-19 | 130 | 600 | 2.5 | A | A |
| 129 | P-20 | 140 | 600 | 1.7 | A | A |
| 130 | P-21 | 130 | 500 | 0.8 | A | A |
| 131 | P-22 | 130 | 500 | 2.7 | B | B |
| 132 | P-23 | 120 | 400 | 3.3 | B | B |
| 133 | P-24 | 120 | 400 | 1.2 | B | B |
| 134 | P-25 | 120 | 400 | 1.6 | C | D |
| 135 | P-26 | 120 | 200 | 0.6 | C | B |
| 136 | P-27 | 120 | 300 | 2.4 | C | B |
| 137 | P-28 | 130 | 400 | 2.4 | A | A |
| 138 | P-29 | 130 | 400 | 1.9 | A | A |
| 139 | P-30 | 130 | 400 | 1.2 | A | A |
| 140 | P-31 | 130 | 500 | 1.6 | A | A |
| 141 | P-32 | 130 | 500 | 2.8 | B | B |
| 142 | P-33 | 130 | 500 | 2.1 | B | B |
| 143 | P-34 | 130 | 400 | 3.4 | B | B |
| 144 | P-35 | 140 | 400 | 1.1 | B | B |
| 145 | P-1 | 140 | 500 | 0.5 | C | C |
| 146 | P-4 | 140 | 400 | 4.4 | A | B |

TABLE 6-continued

| Comparison Example | Kind of finish | Heater surface temperature (° C.) | Fabrication speed (m/minute) | Attached amount (%) | Antistatic characteristic | Dyeing characteristic |
|---|---|---|---|---|---|---|
| 31 | R-1 | 130 | 300 | 1.8 | E | E |
| 32 | R-2 | 130 | 200 | 1.9 | E | E |
| 33 | R-3 | 130 | 500 | 2.4 | E | E |
| 34 | R-4 | 130 | 500 | 2.2 | E | E |
| 35 | R-5 | 130 | 500 | 2.3 | E | E |
| 36 | R-6 | 130 | 500 | 2.5 | E | E |
| 37 | R-7 | 130 | 600 | 1.7 | C | D |
| 38 | R-8 | 130 | 600 | 1.3 | D | E |
| 39 | R-9 | 130 | 600 | 1.9 | E | E |
| 40 | R-10 | 130 | 600 | 2.4 | E | E |

What is claimed is:

1. A straight-type finish for synthetic fibers comprising a lubricant at 70-99.5 mass % of the total and a functional improvement agent at 0.5-30 mass % of the total, a metal organic sulfonate shown by formula 1 being contained at least as a part of said functional improvement agent at 0.05-15 mass % of the total, said formula 1 being

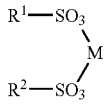

where $R^1$ and $R^2$ are each alkyl group with 1-36 carbon atoms, alkenyl group with 2-24 carbon atoms, phenyl group, alkyl-phenyl group having alkyl group with 1-36 carbon atoms, naphthyl group, alkyl-naphthyl group having alkyl group with 1-36 carbon atoms, or 1,2-bis(alkyloxycarbonyl)-1-ethane group having alkyl group with 4-24 carbon atoms; and M is a divalent metal.

2. The straight-type finish of claim 1 wherein $R^1$ and $R^2$ are each alkyl group with 6-22 carbon atoms, alkyl-phenyl group having alkyl group with 8-18 carbon atoms, or alkyl-naphthyl group having alkyl group with 8-18 carbon atoms.

3. The straight-type finish of claim 2 wherein M is calcium or magnesium.

4. The straight-type finish of claim 1 containing said metal organic sulfonate at 1-10 mass % of the total.

5. The straight-type finish of claim 3 containing said metal organic sulfonate at 1-10 mass % of the total.

6. The straight-type finish of claim 1 wherein said lubricant comprises one or more selected from the group consisting of aliphatic ester compounds with 17-60 carbon atoms, mineral oils with viscosity of $2\times10^{-6}$-$2\times10^{-4}$ $m^2/s$ at 30° C. and linear polyorgano siloxanes with viscosity of $1\times10^{-6}$-$2\times10^{-3}$ $m^2/s$ at 30° C.

7. The straight-type finish of claim 5 wherein said lubricant comprises one or more selected from the group consisting of aliphatic ester compounds with 17-60 carbon atoms, mineral oils with viscosity of $2\times10^{-6}$-$2\times10^{-4}$ $m^2/s$ at 30° C. and linear polyorgano siloxanes with viscosity of $1\times10^{-6}$-$2\times10^{-3}$ $m^2/s$ at 30° C.

8. The straight-type finish of claim 1 wherein the functional improvement agent other than said metal organic sulfonate is a nonionic surfactant.

9. The straight-type finish of claim 7 wherein the functional improvement agent other than said metal organic sulfonate is a nonionic surfactant.

10. A processing method for false twisted textured yarns after a false twisting process, said processing method comprising the step of attaching the straight-type finish of claim 1 to said false twisted textured yarns at a rate of 0.1-5 mass % with respect to said false twisted textured yarns.

11. The processing method of claim 10 for false twisted textured yarns wherein the functional improvement agent other than said metal organic sulfonate is a nonionic surfactant.

12. The processing method of claim 10 wherein said false twisting process is carried out by using a contact heater with surface temperature of 100-220° C. at a processing speed of 200-1200 m/minute.

13. The processing method of claim 11 wherein said false twisting process is carried out by using a contact heater with surface temperature of 100-220° C. at a processing speed of 200-1200 m/minute.

14. False twisted textured yarns produced by the processing method of claim 12.

15. The false twisted textured yarns of claim 14 wherein the functional improvement agent other than said metal organic sulfonate is a nonionic surfactant.

16. The false twisted textured yarns of claim 14 wherein said synthetic fibers are polyester synthetic fibers, polyamide synthetic fibers or polylactic acid synthetic fibers.

17. The false twisted textured yarns of claim 15 wherein said synthetic fibers are polyester synthetic fibers, polyamide synthetic fibers or polylactic acid synthetic fibers.

* * * * *